US006516468B2

(12) United States Patent
Minamishin et al.

(10) Patent No.: US 6,516,468 B2
(45) Date of Patent: Feb. 4, 2003

(54) CASH TRANSACTION HAVING ANTITHEFT MECHANISM

(75) Inventors: Hayato Minamishin, Kawasaki (JP); Hayami Abe, Kawasaki (JP); Yuji Tanaka, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/737,735

(22) Filed: Dec. 18, 2000

(65) Prior Publication Data

US 2002/0020736 A1 Feb. 21, 2002

(30) Foreign Application Priority Data

Feb. 16, 2000 (JP) ..... 2000-038540

(51) Int. Cl.[7] ..... G07G 1/14
(52) U.S. Cl. ..... 902/8; 902/13; 902/9
(58) Field of Search ..... 902/13, 8, 9; 235/379

(56) References Cited

U.S. PATENT DOCUMENTS 4,508,260 A * 4/1985 Keir et al. ..... 109/38
4,561,704 A * 12/1985 Smith ..... 312/222
4,577,562 A * 3/1986 Berman ..... 109/24.1
4,615,280 A * 10/1986 Shoop et al. ..... 109/24.1
4,884,514 A * 12/1989 Schockley et al. ..... 109/24.1
6,123,327 A * 9/2000 Holland-Letz et al. ..... 271/4.09

FOREIGN PATENT DOCUMENTS

| | | |
|---|---|---|
| JP | 62-184590 | 8/1987 |
| JP | 5-47288 | 6/1993 |
| JP | 10-306653 | 11/1998 |

* cited by examiner

*Primary Examiner*—Karl D. Frech
*Assistant Examiner*—Daniel A. Hess
(74) *Attorney, Agent, or Firm*—Staas & Halsey LLP

(57) ABSTRACT

A cash transaction machine having an antitheft mechanism capable of preventing the cash from being seized from a cash storage unit inside a housing through an opening formed in the housing is disclosed. The cash transaction machine having the antitheft mechanism according to the invention includes the housing having a hard outer wall with an opening, and a cash dispensing/receiving unit extending out of the housing through the opening from inside of the housing. At least the portion of the cash dispensing/receiving unit arranged outside of the housing is configured with a metal bottom plate, a transverse structure extending substantially parallel to the plane of the bottom plate, and a pair of metal side plates with the bottom ends thereof fixed to the bottom plate, and the ends of the transverse structure are secured to the side plates at a position above the bottom ends of the side plates.

5 Claims, 8 Drawing Sheets

CASH TRANSACTION HAVING ANTITHEFT MECHANISM

BACKGROUND OF THE INVENTION

1. Field of the Invention

The present invention relates to a cash transaction machine having an antitheft mechanism with at least a portion thereof installed in a housing including a hard outer wall.

2. Description of the Related Art

Recently, transactions including depositing and withdrawal of cash have been often automated so that cash transaction machines for conducting unmanned cash transactions such as ATMs (automatic teller machines) and CDs (cash dispensers) have been increasingly used. These cash transaction machines, which have been installed in great numbers at locations such as manned stores, are now being installed at a multiplicity of disperse places, such as unmanned stores, for the convenience of users.

On the other hand, the dispersion of places for installation increases the number of both installed machines and places of installation, while the cases where the machines are installed in remote places are increasing. The result is an increased number of cases of theft. In such, cases, the cash transaction machines are often destroyed by tools such as hammers and the cash stored in the machine is stolen.

To meet this situation, a method has been used to install a cash transaction machine, or especially, a cash storage unit thereof, in a safe-like housing having a thick, hard outer wall. The term "safe" herein is defined as a box having a reinforced structure such that it cannot be destroyed in a short time. In the case where a cash transaction machine (a cash storage unit thereof, in particular) is arranged in a housing having a hard outer wall, as disclosed in Japanese Unexamined Patent Publication (Kokai) No. 10-306653, the antitheft effect can be improved, for example, by employing a safe-like housing having an engaging member which does not allow for easy disengagement between the door and the body of the safe even when an attempt is made to forcibly open the door by inserting a crowbar or the like tool into the gap between the body and the door of the safe.

Unlike the cash storage box disclosed in Kokai No. 10-306653, however, the cash transaction machine, which must dispense and receive cash between the interior and exterior of the safe, like housing, is unavoidably required to have an opening formed in the housing from which a customer service unit including an operation interface with customers and a cash gate port (or cash dispensing/receiving port) must protrude out of the housing. In the past, when the cash transacted was still small in amount, the opening of the safe-like housing was reduced in size to minimize the size of the customer service unit protruded out of the housing for preventing the theft of cash from the internal cash storage unit through the opening of the housing.

However, recently, an amount of cash handled in the cash transaction machine is increasing and as a result the cash dispensing/receiving device tends to be enlarged. Also, from the viewpoint of operation, demand has increased for a larger customer interface. This unavoidably increases the size of the cash gate port and the customer service unit including the customer interface, with the result that it is difficult to maintain a small opening of the safe-like housing.

Consequently, once the customer service unit protruded out of the safe-like housing through the opening is destroyed, the cash storage unit arranged inside of the safe-like housing can be attacked through the opening and cash can be brought out of it. It is required, therefore, to improve the antitheft capability of the cash transaction machine.

Japanese Unexamined Patent Publication (Kokai) No. 62-184590 discloses a paper money dispenser equipped with an antitheft function in order to improve the antitheft capability of the cash transaction machine arranged in the safe-like housing having an outer wall with an opening. The improved antitheft capability of this paper money dispenser is derived from a security gate provided for closing the connecting space (cash transport passageway) formed between the safe for storing the paper money and the paper money dispense port. However, this requires a complicated mechanism for performing the functions described above and thereby gives rise to another problem that the machine becomes larger as a whole and the equipment is expensive.

SUMMARY OF THE INVENTION

The object of the invention is, therefore, to provide a cash transaction machine with an inexpensive, simple structure which includes at least a cash storage unit arranged in a safe-like housing formed with an opening, in order to solve the aforementioned problem, wherein a thief is prevented from stealing the cash, from the cash storage unit and through the opening, by destroying the portion of the housing protruded outwardly from the opening.

In order to achieve the aforementioned object, according to this invention, there is provided a cash transaction machine having an antitheft mechanism which includes a housing including a hard outer wall with an opening, and a cash dispensing/receiving unit extending out of the housing from the inside of the housing through the opening, wherein at least the portion of the cash dispensing/receiving unit arranged outside of the housing includes an antitheft mechanism having a metal bottom plate, a transverse structure extending substantially parallel to the plane of the bottom plate, and a pair of metal side plates with the bottom ends thereof fixed to the bottom plate, the ends of the transverse structure secured to the side plates at a position above the bottom ends of the side plates.

According to one embodiment of the invention, the transverse structure of the cash transaction machine having the antitheft mechanism described above can include a cash carrying device.

According to another embodiment, the transverse structure can include a beam member.

Preferably, the bottom plate extends over a cash storage unit arranged inside the housing. Also, the transverse structure is preferably secured to the side plates by fastening means having a portion engaging the outer surfaces of the side plates.

In view of the fact that at least the portion of the cash dispensing/receiving unit arranged outside of the housing includes the bottom plate, a pair of the side plates fixed on the bottom plate and the transverse structure with the ends thereof fixedly secured to the side plates, when the portion arranged outside of the housing is destroyed in attempt to attack the internal cash storage unit through the opening of the housing, the side plates will be deformed inwardly (toward the portion between the side plates) and fall on the bottom plate by the transverse structure such as the beam member and the cash carrying devices secured to the side plates. The side plates are fixedly mounted on the bottom plate, and therefore the side plates and the transverse structure such as the beam member and the cash carrying devices are stacked on the bottom plate and block the opening.

In this way, the side plates and the transverse structure secured to the side plates perform the function of shutting out the access route through the opening of the housing to the cash storage unit arranged inside the housing, thereby making it possible to prevent the cash storage unit from being attacked through the opening of the housing to seize the cash from the cash storage unit.

On the other hand, the bottom plate and a pair of the side plates are the only main parts newly added to the cash transaction machine according to the invention as compared with the conventional cash transaction machine, and therefore, the structure for improving the antitheft capability according to the invention is simple and accompanied by no substantial increase in cost.

The bottom plate, if it extends over the cash storage unit and covers its upper part, is required to be destroyed to attack the cash storage unit directly through the opening. Since the side plates stacked thereon play the role of reinforcing the bottom plate, the attack against the cash storage unit arranged inside the housing becomes more difficult, thereby improving its antitheft capability.

Also, in the case where the transverse structure is secured to the side plates using fastening means having a portion engaging the surface of the outer portion (outside of the portion between the opposed side plates) of the side plates, it is not easy for the transverse structure to come off the side plates inwardly when an external force is exerted on the transverse structure. Thus, the inward deformation of the side plates is guaranteed.

BRIEF DESCRIPTION OF THE DRAWINGS

The above and other objects, features, and advantages of the present invention will be made more apparent from the following description of the preferred embodiments thereof with reference to the accompanying drawings, wherein.

DESCRIPTION OF THE PREFERRED EMBODIMENTS

A cash transaction machine having an antitheft mechanism according to the present invention will be described below with reference to the accompanying drawings.

Figure 1:
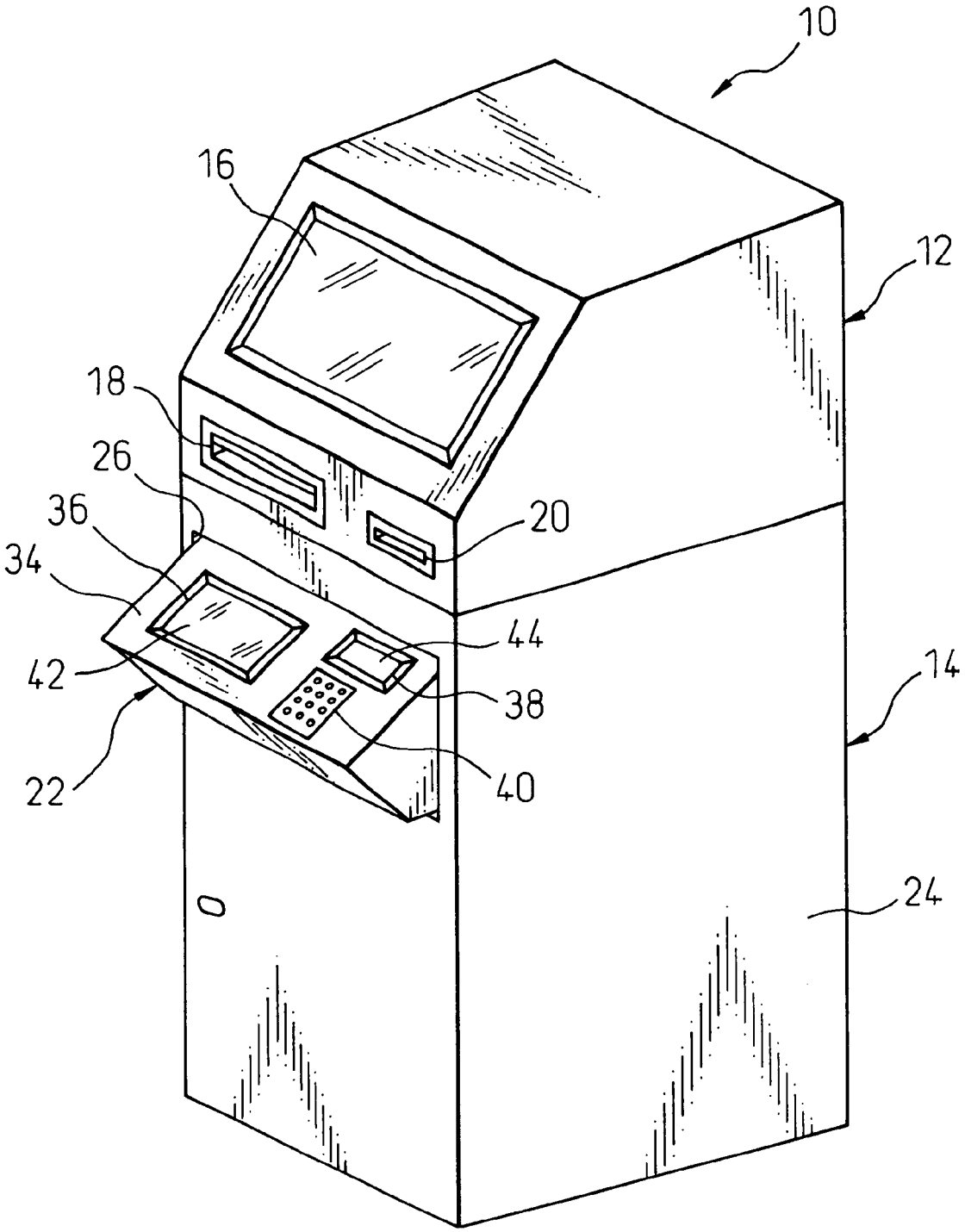
FIG. 1 is a perspective view of a cash transaction machine having an antitheft mechanism according to an embodiment of the invention.
Figure 2:
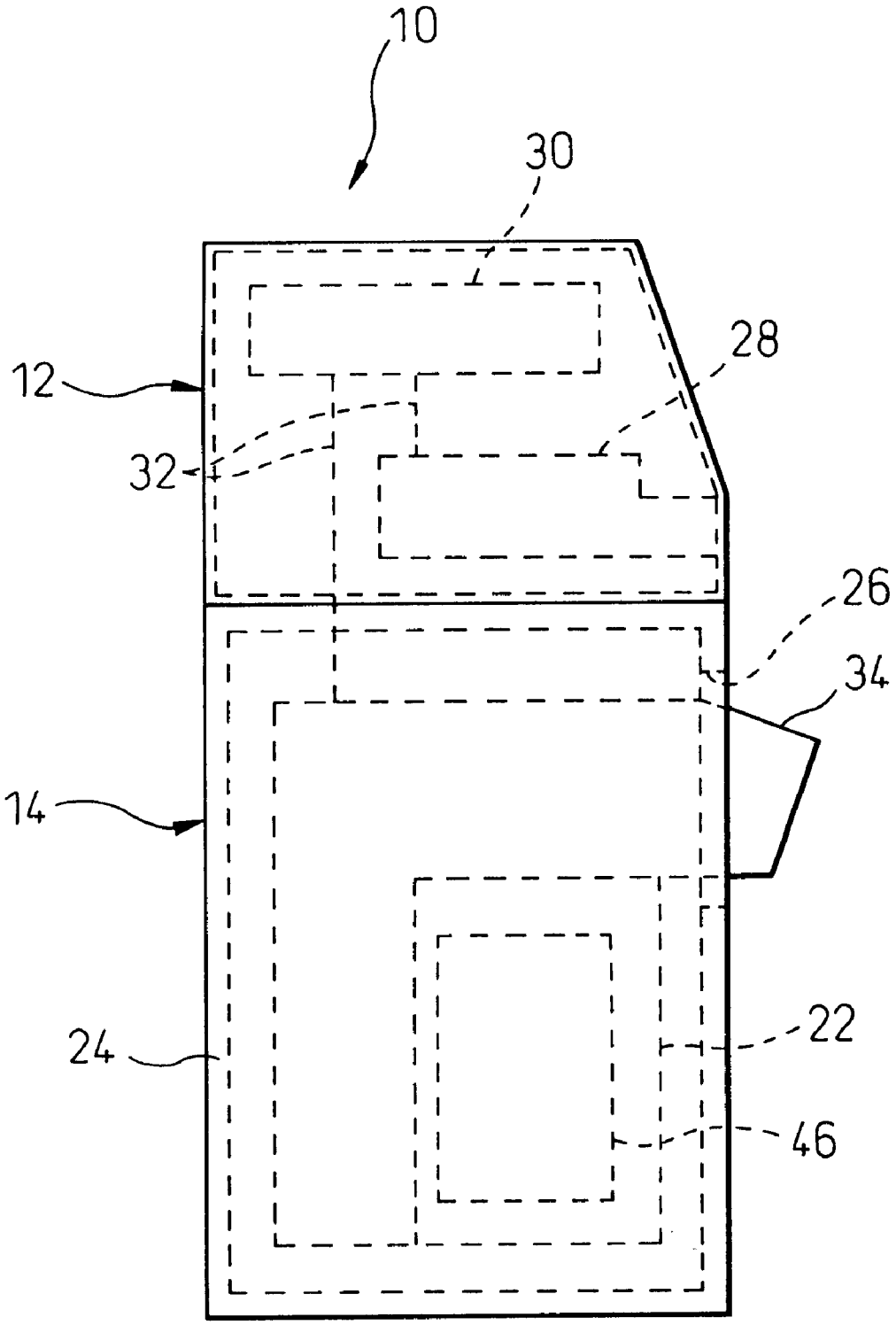
FIG. 2 is a side view of the cash transaction machine having the antitheft mechanism shown in FIG. 1 illustrating the internal structures thereof.

FIG. 1 is a perspective view of an automatic teller machine (ATM) as an example of a cash transaction machine 10 having an antitheft mechanism according to the invention, and FIG. 2 is a side view illustrating the internal structure of the cash transaction machine 10. In addition to the ATM, which is only an illustrative example and is not restrictive, the invention is applicable with equal effect to the other cash transaction machines which can handle cash for transactions with an unspecified number of customers, including those having only the function of cash withdrawal such as the cash dispenser (CD), only the function of cash depositing, only the function of money transfer or the function of both depositing and withdrawal.

The ATM is a machine for conducting money transactions such as cash withdrawal, cash depositing, or transfer to another account, and actually handles cash in many transactions.

Referring to FIG. 1, the cash transaction machine 10 includes an upper portion 12 and a lower portion 14. The upper portion 12 further includes a touch panel 16 for displaying an operating instruction and information to the operator and receiving the input for operation, a passbook insertion hole 18 for inserting the passbook to write a transaction record therein, and a card insertion hole 20 for inserting a card such as a cash card and bank card to identify the operator. The lower portion 14, on the other hand, includes a cash dispensing/receiving device 22 for performing the function of dispensing or receiving cash to or from the operator and a housing 24 having the cash dispensing/receiving device 22 therein. The housing 24 has an outer wall as hard as that of a safe, and the outer wall is formed with an opening 26 through which a portion of the cash dispensing/receiving device 22 can be protruded out of the housing 24. The term "safe" herein is defined as a box having a reinforced structure such that it cannot be destroyed in a short time.

As seen from FIG. 2, the upper portion 12 further includes a card/passbook processing unit 28 for identifying the card and/or writing a transaction record in the passbook and a control unit 30, for controlling the operation of the cash transaction machine 10 as a whole, arranged in its interior. The card/passbook processing unit 28 can receive the passbook inserted from the passbook insertion hole 18 or the card inserted from the card insertion hole 20, and then performs such processes as the identification of the card or the writing of a transaction record in the passbook while communicating with the control unit 30. Based on the process designated as an instruction from the input unit such as the touch panel 16, on the other hand, the control unit 30 controls the operation of the cash dispensing/receiving device 22 and the card/passbook processing unit 28 by transmitting operation signals to them.

The communication between the cash dispensing/receiving device 22, the card/passbook processing unit 28 and the control unit 30 is carried out through a cable 32. The electrical connection between the control unit 30 arranged outside of the housing 24 in the upper portion 12 of the cash transaction machine 10 and the cash dispensing/receiving device 22 arranged inside of the housing 24 can be accomplished by passing a cable through a small through hole formed in the outer wall of the housing 24, and therefore never affects the antitheft capability. The whole of the upper portion 12 may of course be accommodated in the housing 24.

The cash dispensing/receiving device 22 encased in the lower portion 14 of the cash transaction machine 10 includes the portion extending out of the housing 24 through the opening 26 from inside of the housing 24. A customer service unit 34 for dispensing and receiving the cash directly between the operator and the cash transaction machine 10 is located on this portion arranged outside of the housing 24. Referring to FIG. 1, the customer service unit 34 includes a paper money gate port (or paper money dispensing/receiving port) 36, a coin gate port (or coin dispensing/receiving port) 38 and a key input unit 40 for inputting a PIN (personal identification number). The paper money gate port 36 and the coin gate port 38 have closing doors 42, 44.

Figure 3:
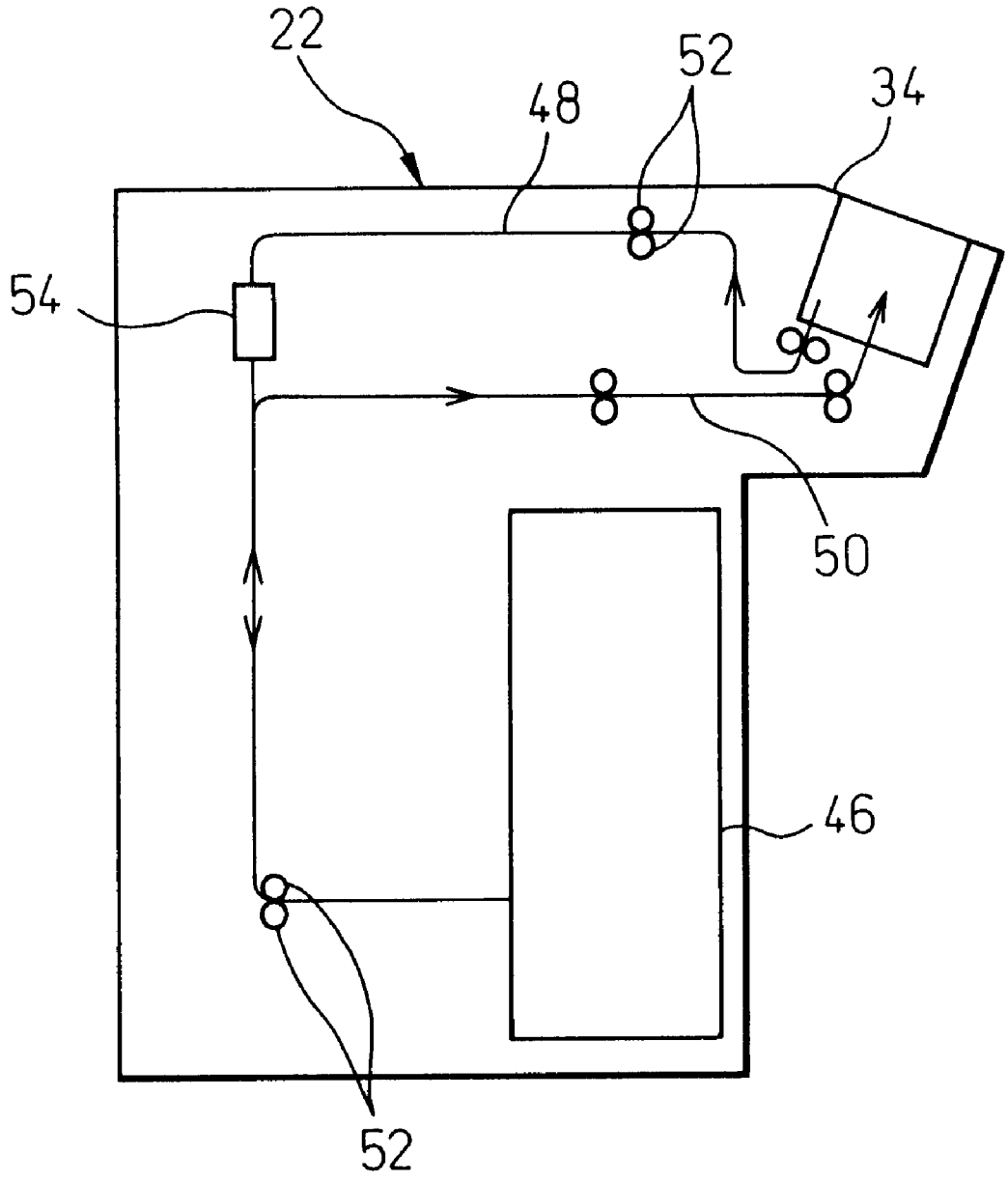
FIG. 3 is a diagrammatic view illustrating carrying devices arranged along the cash receiving route and the cash dispensing route of the cash dispensing/receiving device of the cash transaction machine shown in FIG. 2.

The cash dispensing/receiving device 22 arranged in the housing 24 contains a cash storage unit 46 therein as shown in FIG. 3. The cash is transported by carrying devices 52 arranged along the receiving route 48 and the dispensing route 50 between the paper money gate port 36 and the coin gate port 38 of the customer service unit 34 and the cash storage unit 46. In FIG. 3, for simplification, only several rollers are shown in the carrying device for the paper money. The carrying device for the paper money, however, includes a multiplicity of other rollers and guides as described later. Further, the carrying devices 52 include that for coins (not shown).

In depositing or transferring of money to another account, the paper money or coins are received by the paper money gate port 36 or the coin gate port 38, and transported by the carrying devices 52 to the cash storage unit 46 through a verification unit 54 located on the money receiving route 48. In withdrawing money, on the other hand, the money or coins are transported from the cash storage unit 46 by the carrying devices 52 to the paper money gate port 36 or the coin gate port 38, and delivered to the operator through the paper money gate port 36 or the coin gate port 38, respectively. As described above, the customer service unit 34 located at the portion of the housing 24 extending outward through the opening 26 is indispensable for a cash transaction machine 10. Since the customer service unit 34 is exposed to the outside of the housing 24 and is easy to destroy, however, the cash storage unit 46 placed in the housing 24 can be attacked through the opening 26 of the housing 24 by destroying and removing the portion of the device 22 arranged outside of the housing 24 including the customer service unit 34. In view of this, according to the invention, the portion of the device 22 arranged outside of the housing 24 including the customer service unit 34 of the cash dispensing/receiving device 22 of the cash transaction machine 10 has a particular antitheft mechanism for an improved antitheft capability.

The structure of the cash dispensing/receiving device 22 of the cash transaction machine 10 having the antitheft mechanism according to the invention will be described below.

Figure 4:
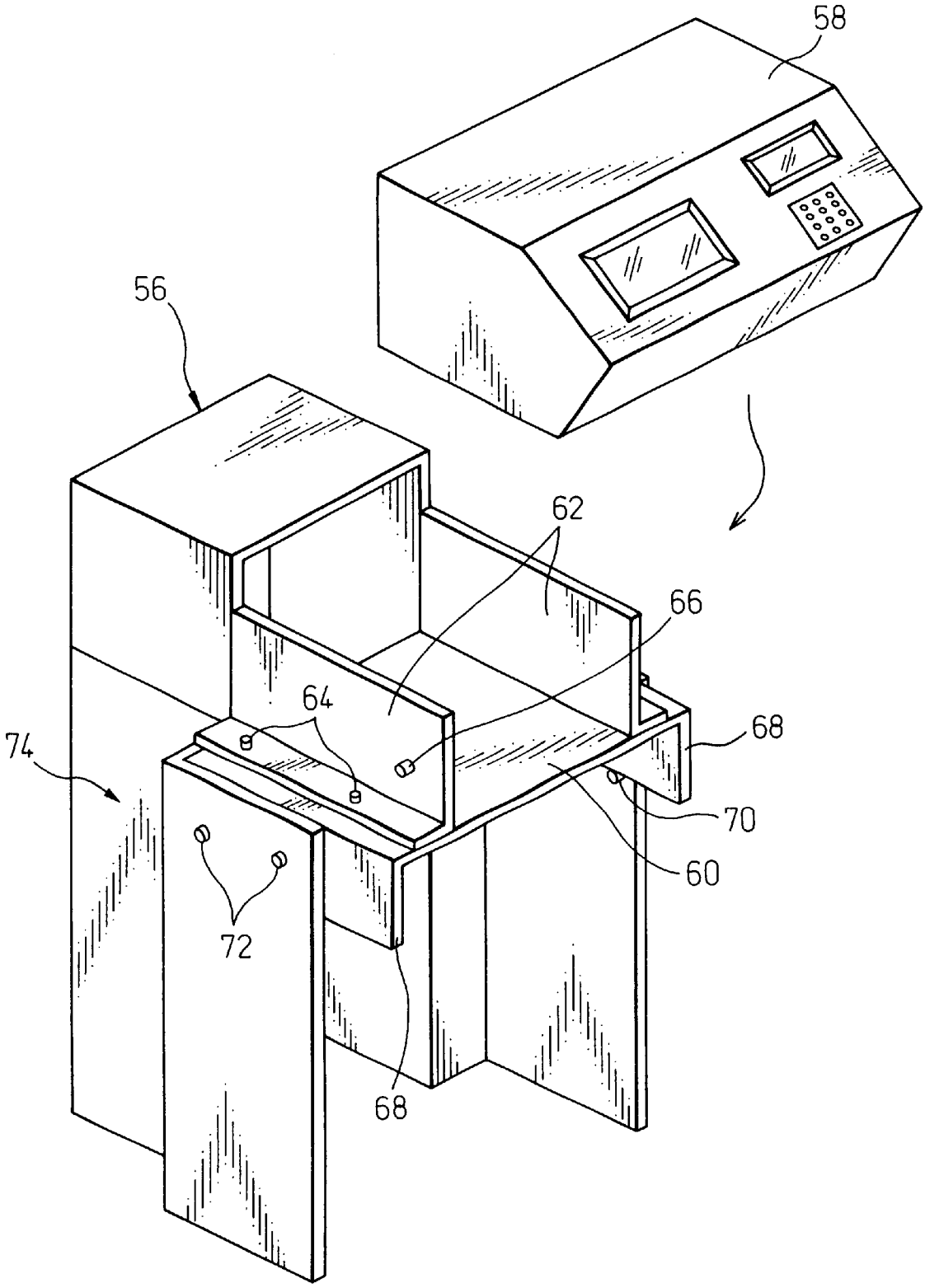
FIG. 4 is a perspective view of a first embodiment of a support frame structure of the cash dispensing/receiving device shown in FIG. 3.

FIG. 4 is a perspective view of a first embodiment of a support frame structure 56 of the cash dispensing/receiving device 22. The other portions of the cash dispensing/receiving device 22 including the cash storage unit 46, the carriers 52 and other mechanisms are not shown in FIG. 4.

In the cash transaction machine 10 according to the invention, the side portion and the upper portion of the customer service unit 34 are surrounded by a front cover 58 shown in FIG. 4, and a bottom plate 60 of a metal such as iron is located beneath the bottom portion of the customer service unit 34. The bottom plate 60 extends over the bottom portion of the customer service unit 34 protruded out of the housing 24 and further into the housing 24.

A pair of side plates 62 of a metal such as iron extending from the front side (facing the operator) to the rear side have the bottom ends thereof fixed on the bottom plate 60. Further, between the pair of the side plates 62, an operating mechanism for the closing doors 42, 44 of the paper money gate port 36 and the coin gate port 38 of the customer service unit 34 and the carrying devices 52 for the paper money and coins are fixedly supported, at their ends, on the side plates 62, thus functioning as transverse structures for the side plates 62. Each of the side plates 62 has an L-shaped section as shown in FIG. 4 and the lower side portion (bottom end) thereof is fixed on the bottom plate 60. The side plates 62 are fixed on the bottom plate 60 preferably by using fastening means 64 such as bolts as shown in FIG. 4. Nevertheless, other joining methods, such as welding, assuring a sufficient coupling strength may alternatively be used. Also, only some of the operating mechanism for the closing door and the carrying devices 52 may be fixedly supported on and transversely of the opposed side plates 62 as transverse structures.

A swing post 66 extending toward the outer side (the portion sandwiched between the opposed side plates 62 is defined as the inner side) of the side plates is arranged on the front side (the side facing the operator) of each of the side plates 62. The front cover 58 is swingably mounted on the side plates 62 by the engagement between the swing post 66 and the corresponding recesses (not shown) formed in the side walls of the front cover 58.

As shown in FIG. 4, the support frame structure 56 of the cash dispensing/receiving device 22 has a substantially C-shape in a horizontal cross section, and the front portion of the spice between the sides of the support frame structure 56 is wider than the rear portion thereof. The bottom plate 60 with the side plates 62 fixed thereon is mounted on the front wide space portion of the support frame structure 56. In the shown embodiment, leg portions extend downwardly from the side ends of the bottom plate 60 and form a substantially C-shaped cross section of the bottom plate 60. The leg portions 68 of the bottom plate 60 rest on protrusions 70 formed on the inner surface of the support frame structure 56. Further, the bottom plate 60 is fixed on the support frame structure 56 by mounting the leg portions 68 to the support frame structure 56 with fastening means 72 such as bolts. The bottom plate 60 may alternatively be fixedly secured to the support frame structure 56 by welding or the other joining methods.

The cash storage unit 46 is arranged in the wide space portion having the sides thereof defined by the side walls of the support frame structure 56 and the upper portion thereof defined by the bottom plate 60. The presence of the bottom plate 60 makes it difficult to attack the cash storage unit 46 directly through the opening 26 from the portion arranged outside of the housing 24 including the customer service unit 34.

The carrying devices 52 for transporting the cash between the cash storage unit 46 and the customer service unit 34 as well as other devices are arranged in the narrow space between the rear portion of the side walls of the support frame structure 56. Carrying devices 52 are also, of course, arranged between the side plates 62 fixed on the bottom plate 60. As described above, at least some of the carrying devices 52 arranged between the side plates 62 extend transversely between the side plates 62 and the ends thereof are secured to the side plates 62.

The wiring, etc. are arranged in the outer peripheral region (recess region) 74 located outside of the narrow rear portion of the support frame structure 56. The support frame structure 56 as well as the wiring and the power mechanism arranged around the support frame structure 56 are surrounded by a substantially rectangular cover (not shown) and the front cover mounted on the side plates 62 are used to protect the customer service unit 34, thus forming the cash dispensing/receiving device 22 as shown in FIG. 2.

Figure 5:
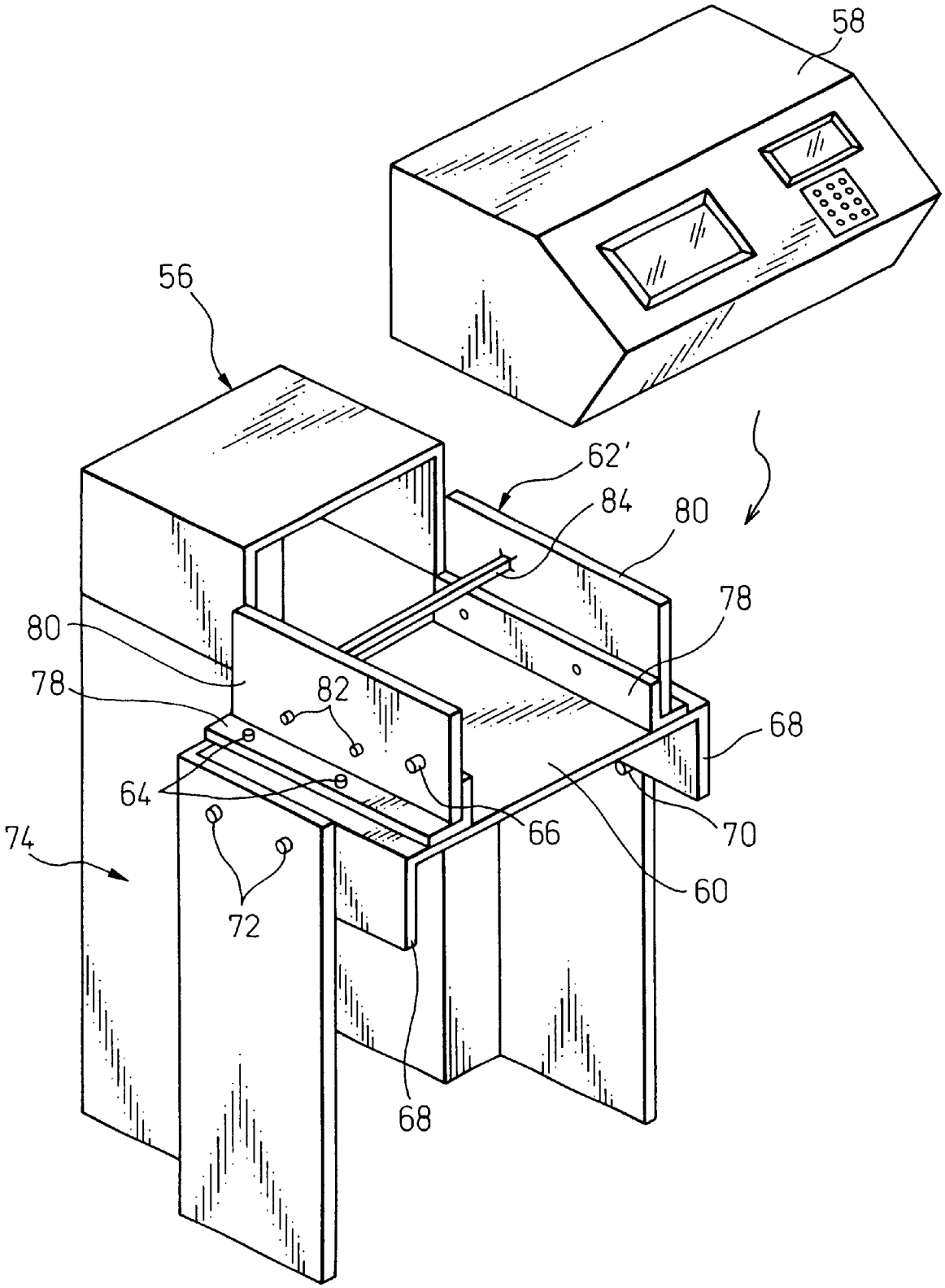
FIG. 5 is a perspective view of a second embodiment of a support frame structure of the cash dispensing/receiving device shown in FIG. 3.

FIG. 5 is a perspective view a second embodiment of the support frame structure 56 of the cash dispensing/receiving device 22. Similar to FIG. 4, the cash storage unit, the carrying devices and other mechanisms are omitted. The same components as those shown in FIG. 4 are designated by the same reference numerals.

The side plates of the support frame structure 56 shown in the embodiment of FIG. 5 are different from those shown in the embodiment of FIG. 4. Referring to FIG. 5, each side plate 62' is comprised of an separate L-shaped angle member 78 and a flat plate 80. The angle member 78 and the flat plate 80 are joined to each other by fastening means 82 such as bolts or by any suitable joining method such as welding. Further, the angle member 78 is formed integrally with the rear portion of the support frame structure 56 and extends forward like an arm. Thus, the bottom plate 60 is held between the protrusions 70 formed on the front portion of the support frame structure 56 and the angle members 78 extending like arms and integrated with the rear portion of the support frame structure 56, thereby securing the bottom plate 60 even more firmly to the support frame structure 56. As a result, this configuration makes it difficult to remove the bottom plate 60 from the support frame structure 56, thereby improving an antitheft capability.

Also, a beam member 84 made of a metal such as iron is arranged as a transverse structure between the side plates 62' shown in FIG. 5, whereby the inward fall of the side plates 62' is more positively guaranteed should the customer service unit 34 be destroyed. The beam member 84 is fixedly secured to the side plates 62' by welding or the like method resulting in a sufficiently high coupling strength and will not come easily off the side plates 62' under an external force.

The other portions of the support frame structure 56 have the same configuration and are fastened and joined in the same way as in FIG. 4, and therefore the description thereof will be omitted here.

Figure 6:
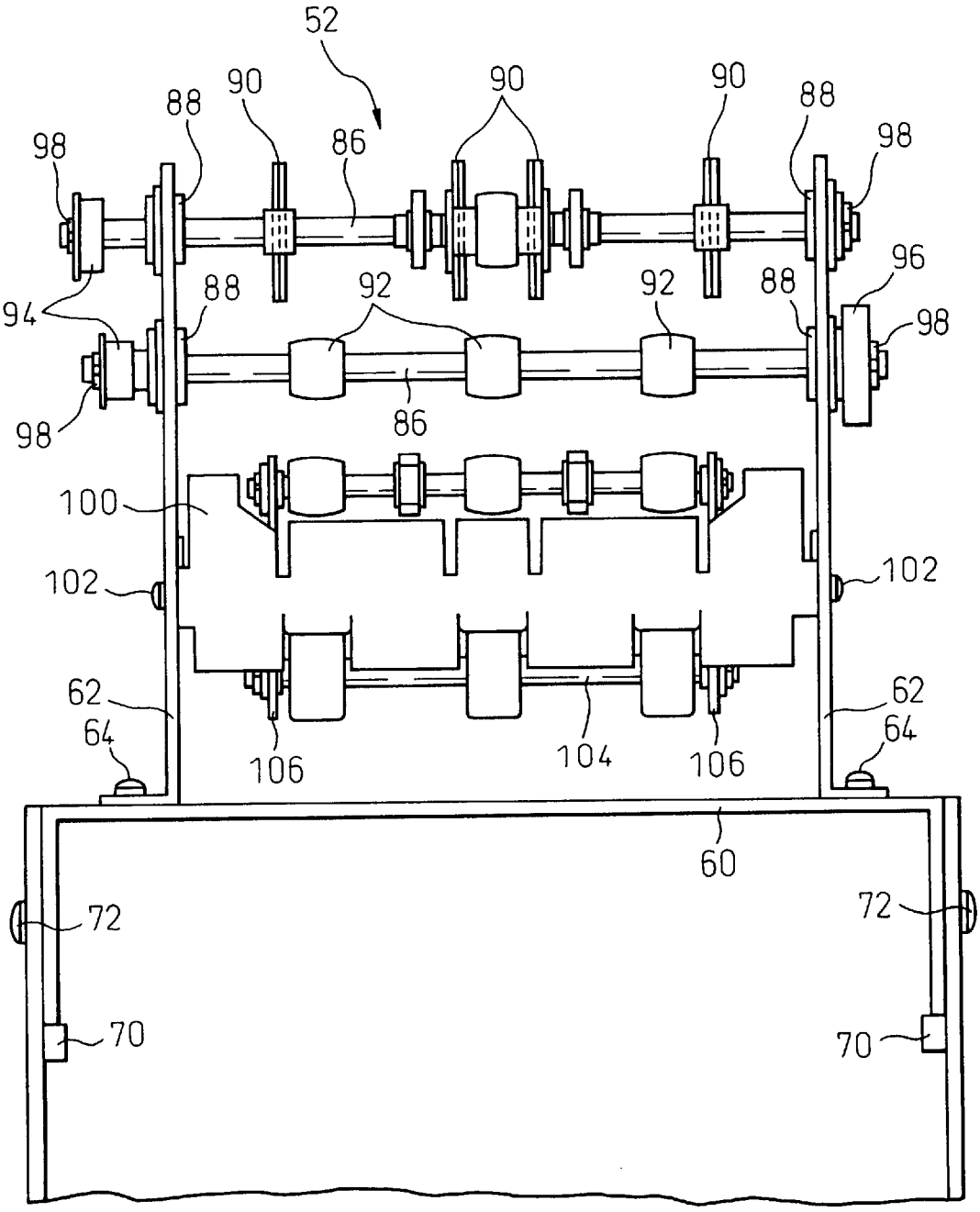
FIG. 6 is a diagrammatic view illustrating an embodiment of a structure for mounting the carrying devices on side plates of the machine, in which the drive mechanism and the belt for power transmission are not shown for simplification.

FIG. 6 is a diagrammatic view illustrating an embodiment of a structure for mounting the carrying devices 52 on the side plates 62 (62').

Referring to FIG. 6, the shaft 86 of the carrying device 52 extends through the side plates 62 and is rotatably mounted on the side plates 62 by flanged bearings 88. The shaft 86 is made of a metal such as iron. Instead of the flanged bearings 88, flanged bushings or the like may be used. As seen from FIG. 6, the flange portion of the bearings 88 is arranged outside of the side plates 62. Impellers 90, rollers 92 and belts (not shown), which are required for transporting the paper money, are arranged inside of the side plates 62, while timing pulleys 94, a gear 96 and the like, which are not directly related to the transportation, are arranged outside of the side plates 62. Retaining rings 98 are mounted in the outermost position. This arrangement prevents the shaft 86 from coming off easily from the side plates 62 under an external force. An external force which may be exerted on the shaft 86, therefore, is transmitted to the side plates 62 through the shaft 86 and causes the side plates 62 to fall inward.

In the lower part of FIG. 6, an iron guide plate 100 is seen to be fixedly secured to the side plates 62 by fastening means 102, such as screws, from outside of the side plates 62. Also, a shaft 104 with rollers mounted thereon is supported by and secured to inner plates 106 arranged inside of the side plates 62. The shaft 104 is mounted in the same way as the shaft 86 is secured to the side plates 62 as described above, so that the external force exerted on the shaft 104 is transmitted to the inner plates 106 thereby to make the inner plates 106 fall inwardly. Though not seen from FIG. 6, the inner plates 106 are secured to the side plates 62. The inner plates 106, however, may of course be secured alternatively to the bottom plate 60.

Figure 7:
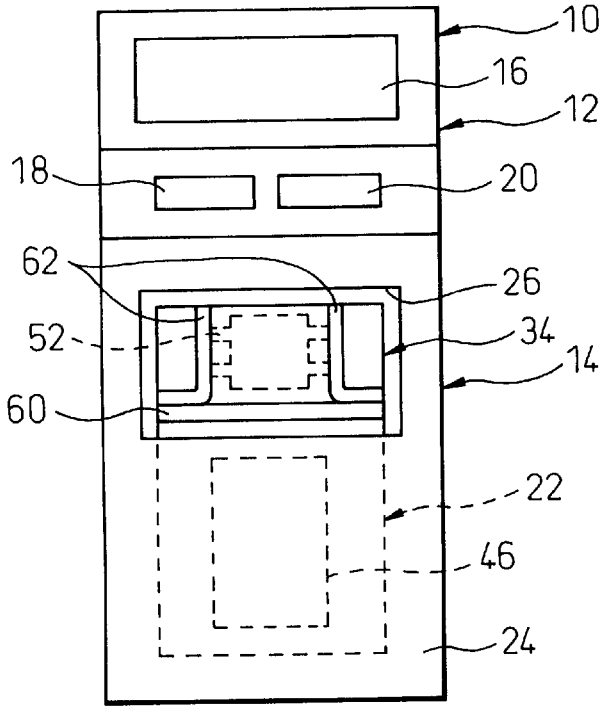
FIG. 7 is a diagrammatic view illustrating the normal state of the cash transaction machine having the antitheft mechanism according to the invention.
Figure 8:
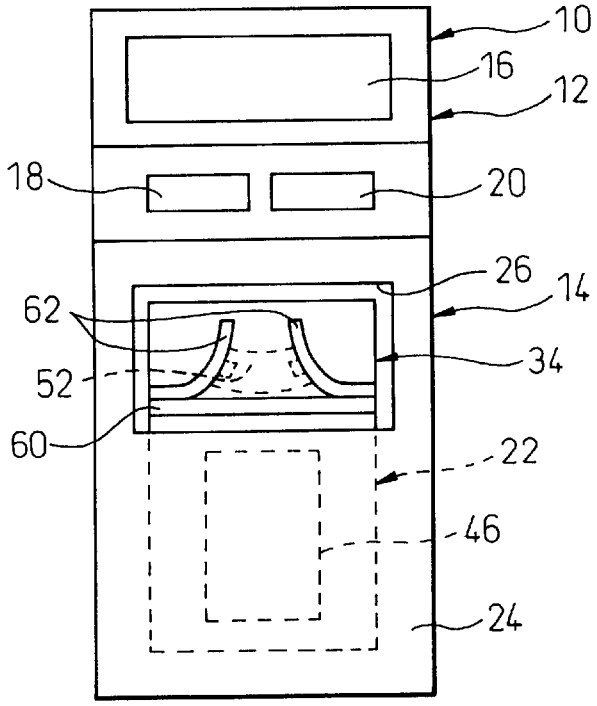
FIG. 8 is a front view of a cash transaction machine having an antitheft mechanism according to the invention with the portion thereof outside of the housing destroyed.
Figure 9:
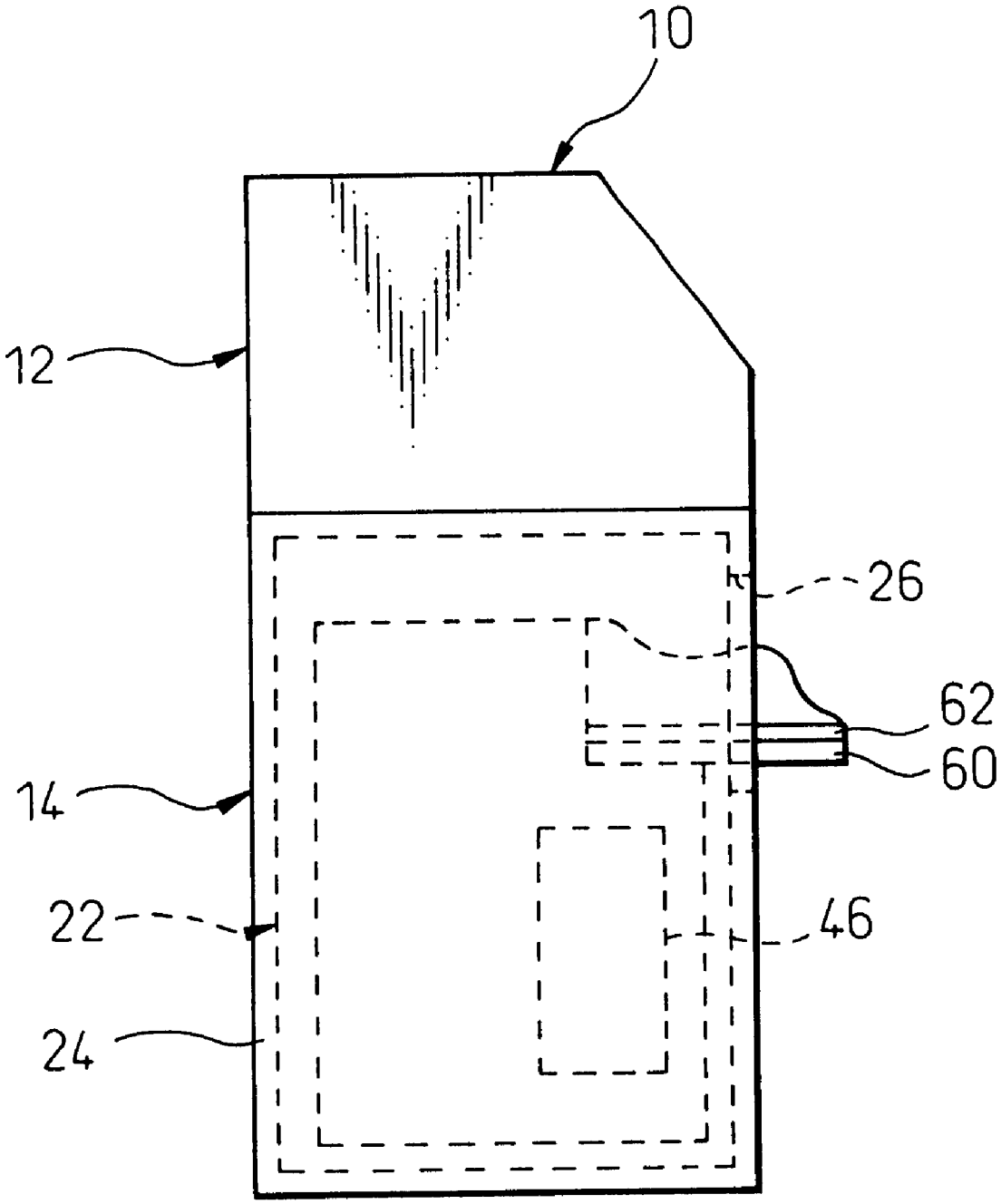
FIG. 9 is a side view of a cash transaction machine having an antitheft mechanism according to the invention with the portion thereof outside of the housing destroyed.

The antitheft function of the cash transaction machine 10 according to the invention will be now described with reference to FIGS. 7 to 9. FIG. 7 is a diagrammatic view illustrating the normal state of the cash transaction machine 10 according to the invention. FIG. 8 is a front view of the cash transaction machine 10 according to the invention with the portion thereof outside of the housing 24 destroyed, and FIG. 9 is a side view of the cash transaction machine 10 according to the invention with the portion thereof outside of the housing 24 destroyed.

The bottom plate 60 is located at the bottom of the portion of the machine arranged outside of the housing 24 including the customer service unit 34 which extends outwardly through the opening 26 from inside of the housing 24, and the side plates 62 are fixed in opposed relation to each other on the bottom plate 60. Also, the ends of the carrying devices 52 and other structures shown by dashed line are fixedly secured to the side plates 62. The carrying devices 52 and the other structures thus extend transversely between the side plates 62 and block the opening 26. As a result, the interior of the housing cannot be normally accessed from outside of the housing 24 through the opening 26.

Suppose that an external force is applied by a hammer or the like to the structures of the customer unit 34 including the carrying devices 52 which block the opening 26, in an attempt to access the interior of the housing 24, and that the structures are destroyed. The external force is transmitted to the side plates 62 through the transverse members including the beam member and the shaft of the carrying devices 52. As a result, as shown in FIG. 8, the side plates 62 fall inwardly, and together with the carrying devices 52, form a mass on the bottom plate 60 and block the opening 26. Further, since the side plates 62 are fixed on the support frame structure 56 of the cash dispensing/receiving device 22 via the bottom plate 60, the side plates 62 and other structures blocking the opening 26 cannot be easily removed from the opening 26. It is, therefore, very difficult for the attacker to access the cash storage unit 46 in the housing 24 through the opening 26. Also, in order to attack the cash storage unit 46 through the opening 26, the bottom plate 60 extending over the cash storage unit 46 must be broken through. However, in view of the fact that the side plates 62 and the carrying devices 52 stacked on the bottom plate 60 reinforce the bottom plate 60, it is not easy to break through the bottom plate 60.

The antitheft capability of the cash transaction machine 10 according to the invention is improved by the aforementioned arrangement, and therefore both the structural complication and the increase in cost can be suppressed.

It will thus be understood from the foregoing description that according to the invention, there is provided a cash transaction machine having an antitheft mechanism, in which, should that portion of the housing having a hard outer wall with an opening which extends outwardly through the opening be destroyed, the side plates are stacked together with the destroyed carrying devices, etc. on the bottom plate located at the bottom of the portion of the machine arranged outside of the housing, thus blocking the opening. Even in the case where the portion arranged outside of the housing including the customer service unit is destroyed, therefore, it is difficult to bring out the cash through the opening from the cash storage unit arranged inside of the housing. Also, the newly required main members are limited to the bottom plate and the side plates, and therefore both the structural complication and the increase in cost are avoided.

Consequently, the antitheft capability can be improved without complicating the structure or increasing the cost.

Although the cash transaction machine according to embodiments of the invention has been described above taking the ATM as an example, the embodiments described above are only illustrative but not limitative. The present invention, therefore, can be variously modified without departing from the scope of the claims appended hereto.

What is claimed is:

1. A cash transaction machine having an antitheft mechanism, comprising:

a housing including a hard outer wall an opening; and a cash dispensing/receiving unit extending out of said housing from the inside of said housing through said opening;

wherein at least the portion of said cash dispensing/receiving unit arranged outside of said housing includes an antitheft mechanism having a metal bottom plate, a transverse structure extending substantially parallel to the plane with the bottom ends thereof fixed on said bottom plate, the ends of said transverse structure secured to said side plates at an intermediate position between the top ends and the bottom ends of said side plates.

2. The cash transaction machine having an antitheft mechanism according to claim 1, wherein said transverse structure includes a cash carrying device.

3. The cash transaction machine having an antitheft mechanism according to claim 1, wherein said transverse structure includes a beam member.

4. The cash transaction machine having an antitheft mechanism according to claim 1, wherein said bottom plate extends over a cash storage unit arranged inside said housing.

5. The cash transaction machine having an antitheft mechanism according to claim 1, wherein said transverse structure is secured to said side plates by fastening means having a portion engaging the outer surfaces of said side plates.

* * * * *

UNITED STATES PATENT AND TRADEMARK OFFICE

CERTIFICATE OF CORRECTION

PATENT NO. : 6,516,468 B2
DATED : February 4, 2003
INVENTOR(S) : Hayato Minamishin et al.

It is certified that error appears in the above-identified patent and that said Letters Patent is hereby corrected as shown below:

Column 9,
Line 24, after "wall" insert -- with --.

Signed and Sealed this

Eighth Day of April, 2003

JAMES E. ROGAN
*Director of the United States Patent and Trademark Office*